United States Patent [19]

Quam et al.

[11] Patent Number: 4,789,072

[45] Date of Patent: Dec. 6, 1988

[54] HYDRAULIC MANHOLE COVER LIFTER

[76] Inventors: Dean R. Quam, 4627 Queen Ave. N., Minneapolis, Minn. 55412; Robert J. Schmitz, 16183 Flagstaff Ct. S., Rosemount, Minn. 55068

[21] Appl. No.: 40,031

[22] Filed: Apr. 20, 1987

[51] Int. Cl.[4] ..... B66C 23/18

[52] U.S. Cl. ..... 212/166; 212/162; 212/142.1

[58] Field of Search ..... 212/166, 203, 205, 213, 212/162, 218–221, 244, 254, 265, 124, 125, 140, 142.1; 414/609, 629

[56] References Cited

U.S. PATENT DOCUMENTS

| | | | |
|---|---|---|---|
| 270,675 | 1/1883 | Hunter | 212/218 |
| 491,933 | 2/1893 | Aiken | 212/213 |
| 2,068,825 | 1/1937 | Stevenson | 212/254 |
| 2,804,979 | 9/1957 | Lassiter | 212/265 |
| 3,281,880 | 11/1966 | Bender . | |
| 3,689,369 | 9/1972 | Tucker | 212/166 |
| 4,076,215 | 2/1978 | Landert . | |
| 4,157,811 | 2/1978 | Haller . | |
| 4,181,290 | 1/1980 | Affolter . | |
| 4,365,925 | 12/1982 | Girtz . | |
| 4,515,660 | 5/1985 | Kwasnik . | |
| 4,546,891 | 10/1985 | Lanigan . | |

FOREIGN PATENT DOCUMENTS

| | | | |
|---|---|---|---|
| 2045206 | 10/1980 | United Kingdom | 212/166 |

*Primary Examiner*—Sherman D. Basinger
*Assistant Examiner*—Stephen P. Avila
*Attorney, Agent, or Firm*—Merchant, Gould, Smith, Edell, Welter & Schmidt

[57] ABSTRACT

A manually actuated, hydraulic manhole cover lifter (10) comprises a frame (12) mounted on wheels (58)and adapted to straddle a manhole. An actuator (30) is mounted on the frame. The actuator comprises a cylinder (36) connected to a pump (34). A magnet (50) is connected to the cylinder (36) for engagement with the metallic manhole cover.

9 Claims, 1 Drawing Sheet

HYDRAULIC MANHOLE COVER LIFTER

TECHNICAL FIELD

The present invention relates generally to a lifting device, and more particularly to a portable, manually actuated hydraulic device for magnetically engaging and lifting and lowering manhole covers.

BACKGROUND ART

Manhole covers are used to close manholes leading from street level down to a sewer or other utility connections. Of course, before such manholes can be entered their covers must be removed. Such covers are usually made of cast iron and tend to be difficult to handle because of their size and weight. For example, some manhole covers can weigh up to 200–300 pounds. Pick axes have typically been used to lift manhole covers. In doing so, the point of the pick ax is first inserted into a peripheral notch or a hole in the center of the manhole cover, so that it can be tilted upwardly and then carried or rolled away to expose the manhole. These manual steps must then be reversed to replace the cover. Injuries to the back, hands and fingers of the workmen have not been uncommon due to the difficulties in handling heavy manhole covers.

Specialized devices have recently been developed to facilitate moving manhole covers. For example, U.S. Pat. No. 4,365,925 shows a manhole cover lifter with a lever arm including a handle at its long end and a hook at its short end, fulcrumed about a pair of wheels so that the cover can be lifted and then rolled into or out of position. U.S. Pat. No. 4,157,811 shows a device wherein the lever arm pivots about vertical as well as horizontal axes on a base positioned next to the manhole so that the cover can be rotated into and out of position while lifted. These devices are essentially levers that provide some mechanical advantage, but still require a fair amount of manual effort.

Powered devices for this purpose have also been available. For example, U.S. Pat. No. 4,181,290 shows another manhole cover lifter with an arm that pivots about a horizontal axis in a base stabilized by retractable legs, but the arm is actuated by a fluid cylinder or a hand operated cable reel on a vertical column extending upwardly from the base. The cover is secured to the arm by adjustable edge pins and a center hook. However, this device only functions to raise the cover to a vertical position adjacent to the manhole and is not adapted to facilitate positioning the cover away from the manhole. After the cover is lifted it is desireable to move it away from the hole for convenient access by workmen and/or their equipment. Aside from interfering with access to the hole, there is also the question of safety should the cover slip or the device tip over.

A need has thus arisen for an improved manhole cover lifter which is not only adapted to engage any type of metallic cover, regardless of the notches or holes therein, but which is designed to hold the cover in a minimum raised position within surrounding framework which can be rolled away from the hole and secured for maximum access and safety.

BRIEF DESCRIPTION OF INVENTION

The present invention comprises an improved manhole cover lifter which overcomes the foregoing and other difficulties associated with the prior art. In accordance with the invention, there is provided a manhole cover lifter comprising a frame adapted to straddle a manhole. The frame includes opposing uprights connected by a transverse member that is preferably supported on wheels for mobility. A manually actuated cylinder is mounted on the frame, with a magnet secured to the depending end of the cylinder, for engagement with the cover.

BRIEF DESCRIPTION OF THE DRAWINGS

A better understanding of the invention can be had by reference to the following Detailed Description in conjunction with the accompanying Drawings, wherein:

FIG. 1 is a perspective view of the manhole cover lifter of the invention with a cover suspended therefrom, positioned away from a manhole;

DETAILED DESCRIPTION

Figures 2, 3:
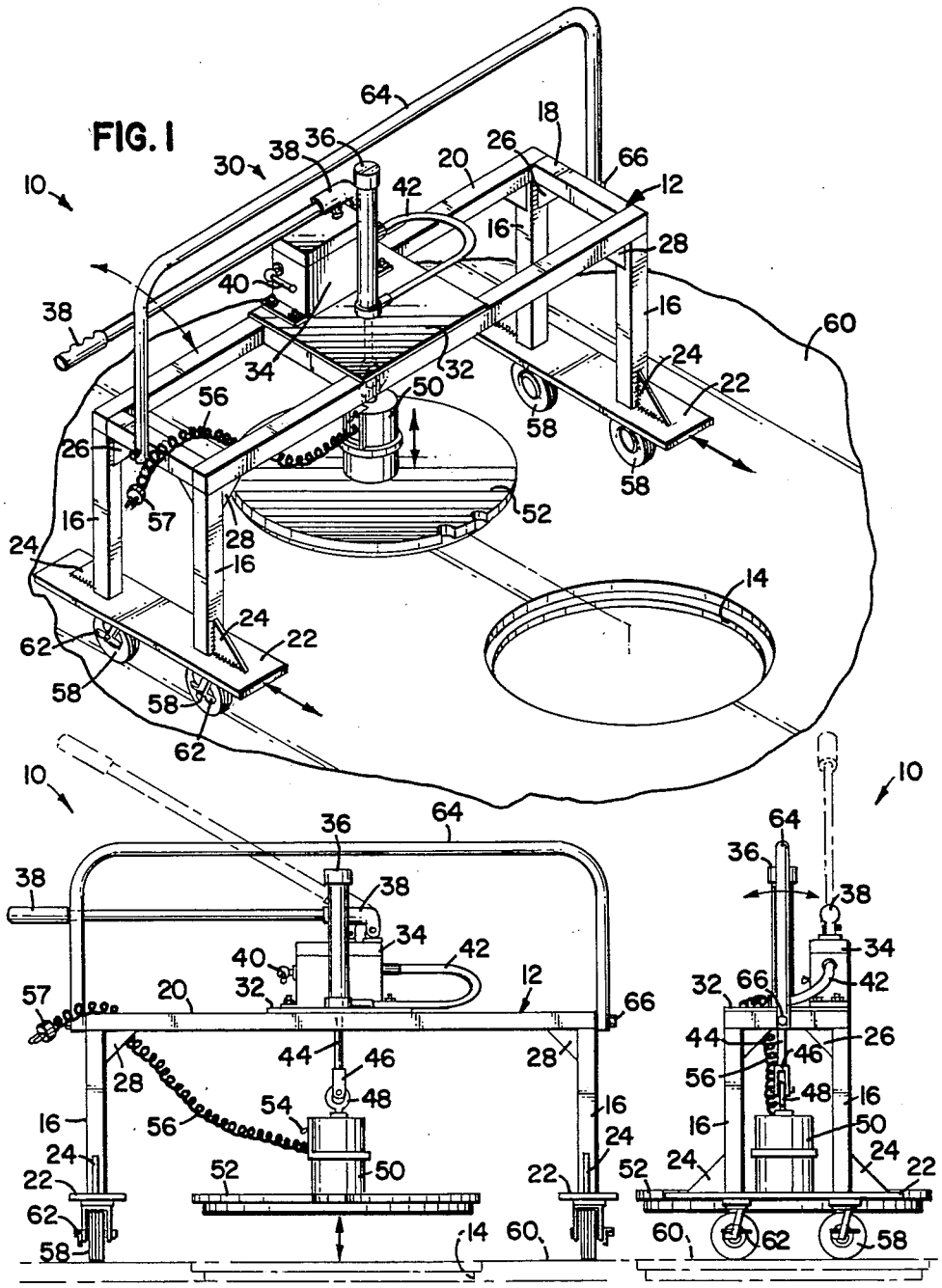
FIG. 2 is a front view of the manhole cover lifter herein.
FIG. 3 is a side view thereof.

Referring now to the Drawings, wherein like reference numerals designate like or corresponding elements throughout the views, there is shown the manhole cover lifter 10 of the invention. The lifter 10 includes a frame 12 which is adapted to straddle a manhole 14. The frame 12 includes opposing pairs of legs or upright members 16 connected at their upper ends by longitudinal top members 18 and transverse cross members 20. The frame members 16, 18 and 20 can be constructed from steel or aluminum tube stock welded together. The bottom ends of each adjacent pair of legs 16 are connected by foot plates 22. If desired, reinforcing gussets 24 can be provided between legs 16 and plates 22, gussets 26 between legs 16 and top members 18, and gussets 28 between the legs and the cross members 20. It will thus be appreciated that the frame 12 comprises a raised structure that straddles the manhole 14. For example, if the manhole 14 is about 30 inches in diameter, frame 12 can be about 36 inches wide, 12–15 inches deep, and 15–17 inches high.

An actuator 30 is mounted on a plate 32 secured between cross members 20 of the frame 12. The actuator 30 comprises a manually actuated hydraulic pump 34 connected to a cylinder 36. The pump 34 includes a handle 38 for pressurizing the fluid therein, a manual release valve 40, and a line 42 extending to the cylinder 36. Any suitable pump and cylinder can be used. For example, the Model P-51 pump from Enerpac Division of Applied Power of Butler, WI. can be used for pump 34. The Model CLH cylinder from Sheffer Corp. of Cincinnati, Ohio, can be used for cylinder 36.

The cylinder 36 includes a depending piston rod 44 which is connected through a clevis 46 and eye bolt 48 to a magnet 50.

As illustrated, the magnet 50 comprises an electromagnet having sufficient power to lift the iron cover 52. The magnet 50 includes an on/off switch 54 and a power cord 56 with a terminal plug 57. Any suitable electromagnet can be used. For example, the model CER-5 Walker-Bux lift magnet rated at 600 pounds from O. S. Walker Company, Inc. of Worcester, Mass., can be used for magnet 50.

If desired, a permanent lift magnet can be used instead of an electromagnet. A Mighty Mite or Junior lift magnet from Creative Magnet Products or Redford, Mich., could be substituted for an electromagnet.

In accordance with the preferred construction, the manhole cover lifter 10 is supported on wheels 58. The wheels 58 are preferably non-castering or swiveling wheels, so that the frame 12 can be guided along a straight line toward and away from the manhole 14 in accordance with the slope on the street surface 60 for maximum control. A lock 62 is preferably provided on each of the wheels 58. If desired, a handle 64 connected to frame 12 at pivots 66, can also be provided.

From the foregoing, it will thus be appreciated that the present invention comprises an improved manhole cover lifter having several advantages over the prior art. The device herein can be easily positioned over a manhole cover, actuated to engage and lift the cover, and then repositioned as desired away from the manhole for maximum access with minimal manual effort. The device herein functions to lift and lower the cover vertically over minimal distance within a protective frame for improved safety. Other advantages will be evident to those skilled in the art.

Although particular embodiments of the invention have been illustrated in the accompanying Drawing and described in the foregoing Detailed Description, it will be understood that the invention is not limited only to the embodiments disclosed, but is intended to embrace any alternatives, equivalents, modifications and/or rearrangements of elements falling within the scope of the invention as defined by the following claims.

What is claimed is:

1. A portable device for handling metallic manhole covers, which comprises:

a mobile frame adapted to straddle a manhole, said frame including spaced apart upright portions interconnected by a raised transverse portion;

a cylinder mounted on the transverse portion of said frame, said cylinder including a depending movable rod;

a magnet secured to the rod of said cylinder and adapted for engaging a cover in the manhole;

a clevis coupled between said magnet and the rod of said cylinder; and manually-actuated pump means for selectively supplying pressurized fluid to said cylinder for lifting and lowering said magnet into and out of engagement with the cover.

2. The device of claim 1, wherein said magnet comprises an electromagnet.

3. The device of claim 1, further including:

a pivotal handle secured to said frame, said handle being generally C-shaped with opposite free ends pivoted to opposite sides of said frame.

4. The device of claim 1, further including:

wheels mounted on the upright portions of said frame; and means for selectively locking at least one of said wheels against rotation.

5. A compact, portable lifter for lifting metal manhole covers, which comprises:

a frame adapted to straddle a manhole;

said frame including opposite pairs of spaced-apart upright members with top and bottom ends, transverse and cross members interconnecting the top ends of the upright members, and foot plates interconnecting the bottom ends of each pair of upright members;

wheels mounted on the foot plates of said frame to support said frame for movement;

a mounting plate secured to the transverse members of said frame;

a generally C-shaped handle with opposite ends pivoted to said frame;

a cylinder mounted on said mounting plate, said cylinder including a depending movable rod;

a magnet secured to the rod of said cylinder and adapted for engaging a cover in the manhole;

a clevis coupled between said magnet and the rod of said cylinder; and manually-actuated pump means for selectively supplying pressurized fluid to said cylinder for lifting and lowering said magnet into and out of engagement with the cover.

6. The lifter of claim 5, wherein said magnet comprises an electromagnet.

7. The lifter of claim 5, wherein said wheels are non-castering so that said frame can be guided along a straight line toward and away from the manhole.

8. The lifter of claim 6, further including:

means for selectively locking at least one of said wheels against rotation.

9. A portable device for handling metallic manhole covers, which comprises:

a mobile frame adapted to straddle a manhole, said frame including spaced apart upright portions interconnected by a raised transverse portion;

a generally c-shaped handle with opposite ends pivoted to said frame;

a cylinder mounted on the transverse portions of said frame, said cylinder including a depending movable rod;

an electromagnet secured to the rod of said cylinder and adapted for engaging a cover in the manhole;

means for connecting said electromagnet to a power source;

a clevis coupled between said magnet and the rod of said cylinder; and manually-actuated pump means for selectively supplying pressurized fluid to said cylinder for lifting and lowering said electromagnet into and out of engagement with the cover.

* * * * *